United States Patent [19]

Groome

[11] 4,088,731

[45] May 9, 1978

[54] METHOD OF SOFTENING NONWOVEN FABRICS

[75] Inventor: Ernest J. Groome, Covington, Va.

[73] Assignee: Clupak, Inc., New York, N.Y.

[21] Appl. No.: 709,543

[22] Filed: Jul. 28, 1976

[51] Int. Cl.[2] ..... D06C 3/00; B29C 17/02

[52] U.S. Cl. ..... 264/282; 264/168; 264/288

[58] Field of Search ..... 264/288, 289, 280, 282, 264/DIG. 81, 168

[56] References Cited

U.S. PATENT DOCUMENTS

| | | | |
|---|---|---|---|
| 2,624,245 | 1/1953 | Cluett | 162/206 |
| 3,047,444 | 7/1962 | Harwood | 264/288 |
| 3,427,376 | 2/1969 | Dempsey | 264/288 |
| 3,772,417 | 11/1973 | Vogt | 264/289 |

*Primary Examiner*—James B. Lowe

[57] ABSTRACT

A bonded web of nonwoven fibers is stretched beyond its elastic limit in one direction sufficiently to permanently elongate those filaments or filament portions of the web extending generally in the direction of the applied tension. This results in a narrowing or necking down of the web in the cross direction and consequent shortening or lateral buckling of those filaments or filament portions extending generally transverse to the direction of applied tension. This imparts increased softness, flexibility and resilient stretchability to the fabric, in that transverse direction. The elongated filaments are then compacted longitudinally while the web is retained in its narrowed condition to impart increased softness, flexibility and resilient stretchability in the longitudinal direction.

5 Claims, 4 Drawing Figures

METHOD OF SOFTENING NONWOVEN FABRICS

BACKGROUND OF THE INVENTION

This invention is in the field of nonwoven fabrics and methods of treating the same.

Nonwoven fabrics include those commonly termed spun-bonded fabrics, which are well known and comprise generally fabrics formed by spinning continuous filaments of suitable materials and laying them in web form with the filaments randomly arranged so that portions extend in all directions. The webs are then treated to cause the filaments to bond to each other at their intersections, either by mechanical bonding, fusion or by the use of separate bonding materials. Such fabrics and method for their manufacture are well known and one such method is described in the patent to Kinney U.S. Pat. No. 3,338,992. A further patent describing these materials is the patent to Hartmann U.S. Pat. No. 3,544,854.

As used in this application, the term nonwoven fabric is intended to refer to fabrics of the type having randomly oriented filaments bonded at their intersections by mechanical means, material fusion or separate bonding materials and whether or not the filaments are continuous.

The known nonwoven fabrics are generally considered unsatisfactory for many purposes because of their stiffness or poor drapability.

The compaction of certain types of nonwovens has traditionally been somewhat less than satisfactory in regards to the improvement in softness obtained. This has been particularly true with spun-bonded fabrics of polyester, polyamide, and polyolefins. It has been felt that the problem lies in the fact that the fiber in these fabrics will absorb very little moisture and, therefore, cannot be plasticized or softened by rewetting. Consequently, because of their greater stiffness at the time of processing, relatively high forces are required to buckle the fiber and compact these fabrics. The result has generally been that compaction of spun-bonded fabrics results in a coarse macrocrepe which results in some stiffness reduction but also an undesirable harsh surface quality. This effect is more or less pronounced depending on the fiber denier and basis weight of the material.

Previous attempts to overcome this problem involved efforts to accurately control compaction temperature so as to soften the fabric and make the fibers more pliable and susceptible to compaction. This has been a generally unsatisfactory solution. Even though the fabric may be considerably shrunk in this manner, upon cooling after compaction, the stiffness of the fabric is seldom reduced and in many instances may actually be increased. Too high a temperature is known to have a detrimental effect on softness.

Attempts were also made to reduce the compressive resistance of the fibers by the addition of chemicals known to act as swelling agents. The results were all unproductive, generally because the chemical agents acted as lubricants and hence interferred with the compaction process. In addition, none of the chemicals evaluated produced a significant reduction in the compressive modulus of the material being treated.

Considerable success has been achieved in improving softness of certain types of fabrics by conventional compaction. However, the conventional compaction process acts predominantly on those fibers and fiber segments, oriented in the longitudinal direction of the fabric. Consequently, the reduction in fabric stiffness obtained by this process is mainly limited to the longitudinal direction of the fabric while stiffness in the fabric's transverse direction is reduced only slightly.

Attempts to increase the compressive forces available also centered on the use of antilubricants to increase the friction between the blanket and the material. Mechanical embossing of the web was also evaluated as a means of increasing friction. Additionally, a harder blanket (60 Shore A Durometer va. 50 Shore A Durometer) had a significant effect. The harder blanket produced a finer compaction particularly on the heavy-weight materials.

SUMMARY OF THE INVENTION

Applicant has discovered that the compressive modulus of many nonwoven fabrics can be considerably reduced by stretching. By stretching a web of the material beyond its elastic limit in the machine direction, that is, the direction of fabric feed and applied tension, and then compacting the same, a considerably better quality compaction could be obtained. This is believed to be due to the reduced compressive modulus of the fabrics, which results in less resistance of the fabric to the compressive force of compaction.

Another very significant benefit is that as the material is stretched, it necks down or narrows in the cross direction so that lateral fiber buckling is achieved. Thus, cross direction stretch of as much as 20% has been realized along with significant reductions in stiffness.

The reference herein to compaction refers to that step or process by which fabrics are shortened in their longitudinal direction while maintaining the sheet or web against increase in thickness or "crepeing".

It is, therefore, an object of this invention to provide a method for the compaction of nonwoven fabrics rendering those fabrics softer and more flexible.

A further object is to provide such a method wherein the fabrics are rendered stretchable in two directions.

Another object is to provide such a method applicable to any material capable of having one dimension appreciably reduced by applying tensile forces at right angles to that dimension.

Further objects and advantages will become apparent from the following description which is made with reference to the accompanying drawings.

DESCRIPTION OF THE PREFERRED EMBODIMENTS

Figure 1:
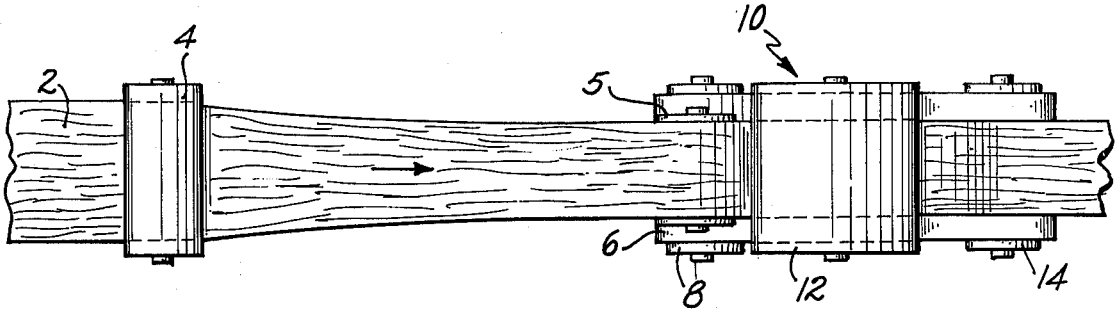
FIG. 1 is a plan view of a schematic representation of apparatus for practicing one form of the present invention.
Figure 2:
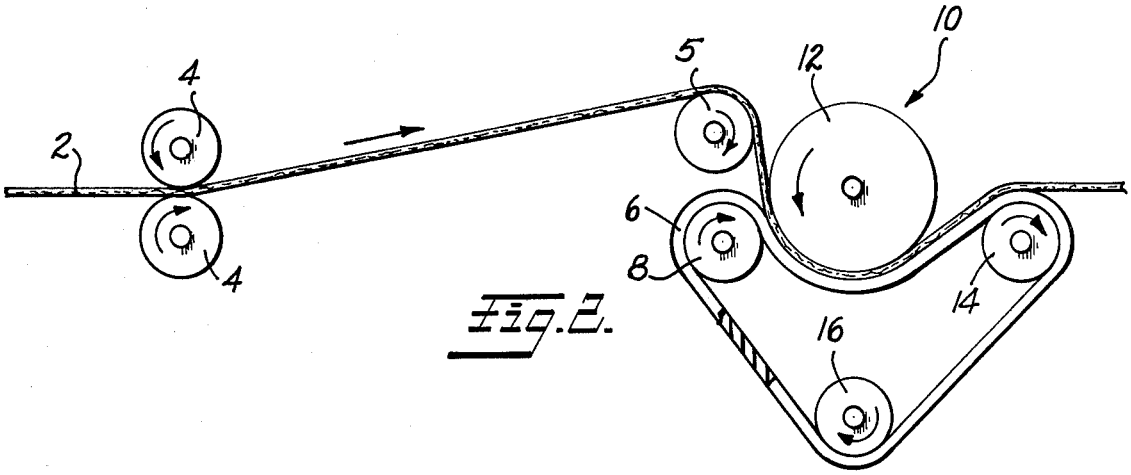
FIG. 2 is a side elevational view of the apparatus schematically shown in FIG. 1.

In the drawings, numeral 2 indicates a web of nonwoven fabric of the type heretofore referred to and is shown as a continuous elongated web of material. In the process as illustrated in FIGS. 1 and 2, the web 2 is fed, from any suitable source, between the nip of feed rollers 4 which are caused to rotate at a predetermined speed to thus predetermine the rate at which the web 2 is fed therepast. From the feed rollers 4 the web 2 is directed over a roller 5 to a cylinder 12 and blanket 6 trained over nip roller 8 of a compacting apparatus 10. The compacting apparatus 10 is of well known construction and operation and is exemplified by the drawings and described in the patent to Cluett U.S. Pat. No. 2,624,245. Briefly, the compacting apparatus comprises a heated cylinder 12 mounted for rotation about its axis. A nip roller 8 is customarily mounted for adjustment toward and from the roller 12 and a relatively thick elastomeric blanket 6 is trained over the nip roller, between the roller 8 and cylinder 12, then over an arcuate portion of cylinder 12 to a take-up roller 14 and then over the return roller 16 from which it is directed back to the nip roller 8. As is known, the action of the blanket 6 held in tension and pressed against the cylinder 12 results in a foreshortening or compaction of web material fed through the apparatus without permitting the web to crepe and maintaining opposed surfaces of the web parallel and of substantially the same thickness. The shortening of the web is accomplished by causing substantially all longitudinally extending filaments thereof to undergo "micro-compression" and to buckle or curve within the body of the web.

As shown in FIGS. 1 and 2, the web 2 is directed from the feed rollers 4 over roller 5 and then to the nip between blanket 6 and cylinder 12 and the speed of operation of the nip roller and cylinder 12 is such that it tends to draw the web 2 at a greater speed than permitted by the feed rollers 4. This results in actually and permanently stretching those web filaments which extend generally in the direction of material feed. At the same time the web width is reduced, as illustrated in FIG. 1, this results in lateral fiber or filament buckling of the fabric. This means that the generally longitudinally extending filaments are being stretched in the feed direction and tend to align themselves with the feed direction and crowd together in the cross direction and thus portions thereof are drawn inwardly toward the center of the web and any generally laterally extending filaments bonded thereto are caused to buckle or kink and the web width is reduced in the lateral direction. This also produces a marked improvement in MD tensile strength. As the web material enters the nip between the blanket 6 and cylinder 12, the well known compaction occurs and in the present instance, the tension of the fabric filament is not only relieved but its longitudinal filaments are actually placed under compression even though its laterally extending and longitudinally extending filaments are compacted, kinked or bent within the confines of the web.

Figure 3:
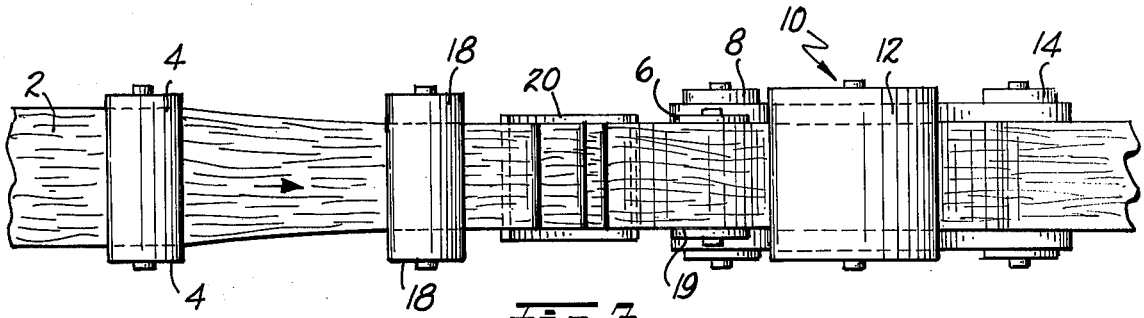
FIG. 3 is a schematic plan view of a modified form of the apparatus for practicing the present invention.
Figure 4:
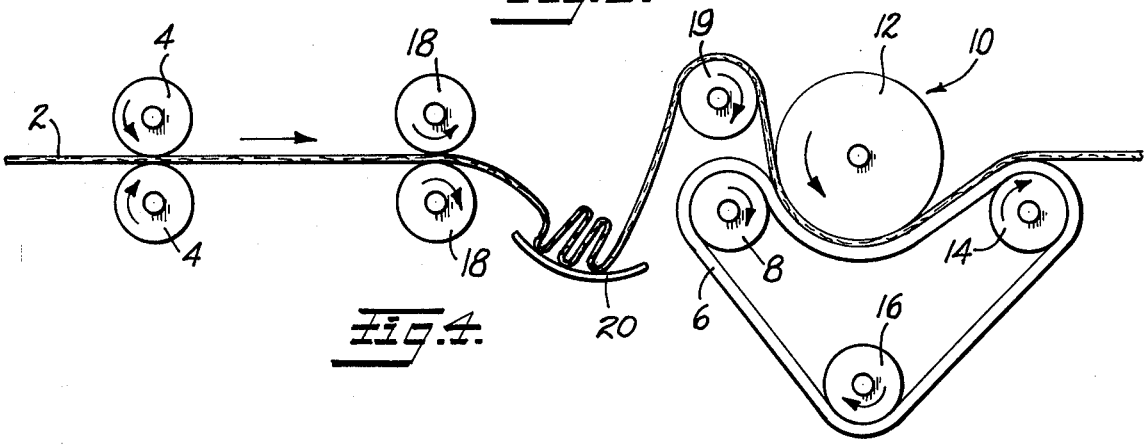
FIG. 4 is a side elevational view of the apparatus of FIG. 3.

In the apparatus and steps illustrated in FIGs. 3 and 4, the web is fed through feed rollers 4, as described with reference to FIGS. 1 and 2, and then through stretching rollers 18 which are driven at a higher speed than the rollers 4 to thus impart a permanent stretch to the web 2 with the consequent reduction in width and lateral fiber buckling already described.

As the web leaves the stretching rollers 18, all tension in the longitudinal direction is relieved and some minor increase in width occurs although the width of the web is still substantially less than it was before stretching. The web is then fed loosely to a suitable accumulator cradle 20 or the like and is fed from there over roller 19 to the nip between blanket 6 and cylinder 12 of compacting apparatus 10, which may be identical to that shown in FIGS. 1 and 2. In the apparatus 10, the web is longitudinally compacted and the product issuing therefrom has substantially identical characteristics to those issuing from the apparatus of FIGS. 1 and 2.

In general, the fabric is stretched until the desired width reduction of the web is produced before feeding the web to the compactor. It has been found that stretching from 10% to 30% reduces the modulus of the material about 35% thus making compaction much easier. It is to be noted that this process first stretches the web in the feed direction, then compacts the web longitudinally in the compactor to a length approximating the original web length before stretching. However, during the time that the longitudinal compaction takes place, the web is prevented from expanding to its original lateral dimension by the fact that it is locked between the blanket 6 and cylinder 12. The generally longitudinally extending filaments are compacted; and the generally laterally extending filament portions are permanently buckled and the resulting fabric exhibits a marked increase in softness and is readily stretchable in both directions, the lateral stretchability being sufficient to recover the original width of the web. Applicant believes that one of the reasons he is able to achieve the results he does, by essentially stretching the material and then returning it to its original length in the compactor, is that the fabric is free to neck down during stretching but it is restricted from returning to its original width when the fabric is shortened in the compactor. These restrictive forces occur because the fabric is sandwiched between the cylinder and the blanket. By this restriction of CD expansion he is actually locking in the CD fiber buckles.

While reference heretofore has been made to the supposition that spun-bonded fabrics could not be compacted in the usual way, since they were hydrophobic and would not absorb moisture, it is not intended that this invention be limited to such hydrophobic materials. It is contemplated that the process may be advantageously used with fabrics composed of other materials having filaments or fibers and wherein the filaments or fibers are bonded at their crossing points in any manner whatsoever.

It has been found that with certain types of nonwoven materials, the addition of a small amount of moisture to the material prior to tensioning of the web results in a considerable increase in the amount of necking down which is accomplished. In addition, this moisture also permits the necking down of the material to be accomplished more easily; i.e., less tensile force. The types of material which were found to be beneficially treated with moisture are those which contain hydrophylic fibers and/or binders. The addition of moisture to these fabrics tends to create a more flexible and more deformable bond so that more elongation of the fabric in the machine direction and hence greater width reduction can be accomplished without rupturing the sheet.

The optimum amount of moisture addition to the material undoubtedly depends on the type of fiber and binder present. It is probably best determined experimentally. Generally the desired moisture will be in the range of 15% to 25% of the sheet weight.

In one specific case when processing a material composed of rayon fibers bonded with an acrylic binder, applicant was able to stretch the air dry fabric only about 8%. This resulted in a cross direction width reduction of 2%. Attempting to stretch the material a greater amount resulted in the sheet being pulled apart. However, by adding 12% moisture to the web, (from 7% originally to 19% total moisture) he was able to stretch the web 20% without difficulty. This resulted in a 12% width reduction which produced a considerable improvement in the textile-like properties of the processed web.

Also, it has been found that the addition of heat during stretching is beneficial to the processing of other types of materials; specifically, materials containing thermoplastic type fibers and/or binders. In this type of material, it is believed that the heat produces the same effect as moisture does in the webs composed of hydrophylic type binders or fibers.

By way of specific examples, four types of spunbonded polyester fabrics were obtained from E. I. DuPont, as follows:

2011: A standard straight fiber fabric of 13 lbs/3000 ft.$^2$

2024: Similar to 2011 but has a weight of 43#/3000 ft.$^2$

2431: A crimped fiber fabric.

T213: A fabric in which the fiber denier is approximately 2.9 vs. 5.5 in the above fabrics. Weight is 21#/3000 ft.$^2$ Each of these fabrics was processed in accordance with the present invention under several different conditions; regular compaction with 50 Shore A and 60 Shore A Durometer blankets, and stretching followed by compaction on the 50 Shore A Durometer blanket and in some cases also with the 60 Shore A Durometer blanket, the results being tabulated herebelow.

| Sample and Treatment | | Basis Weight (#/3000 ft.$^2$) | Stiffness (inches) MD | Stiffness (inches) CD | Tensile (#/in.) MD | Tensile (#/in.) CD | Stretch (%) MD | Stretch (%) CD |
|---|---|---|---|---|---|---|---|---|
| 2011 | | | | | | | | |
| Control | | 13.5 | 3.1 | 3.2 | 3.3 | 2.3 | 24.5 | 27.3 |
| Compacted | 50 | 15.4 | 2.6 | 2.5 | 3.2 | 2.3 | 35.9 | 26.6 |
| Compacted | 60 | 15.1 | 2.7 | 2.5 | 3.1 | 2.2 | 33.1 | 27.1 |
| S+C | 50 | 15.0 | 1.9 | 1.3 | 3.5 | 2.4 | 31.8 | 37.1 |
| 2024 | | | | | | | | |
| Control | | 43.3 | 6+ | 5.6 | 20.1 | 10.8 | 38.9 | 36.6 |
| Compacted | 50 | 46.4 | 3.2 | 4.4 | 16.9 | 12.2 | 47.4 | 38.7 |
| Compacted | 60 | 44.2 | 3.3 | 4.7 | 18.7 | 13.6 | 49.1 | 35.0 |
| S+C | 50 | 49.2 | 2.4 | 2.4 | 23.3 | 12.0 | 53.5 | 56.7 |
| S+C | 60 | 48.3 | 2.4 | 2.5 | 22.1 | 12.3 | 53.0 | 55.4 |
| Control | 53.2 | 4.5 | 3.9 | 12.7 | 11.8 | 51.4 | 73.7 | |
| Compacted | 50 | 54.6 | 2.7 | 3.1 | 13.2 | 10.3 | 67.4 | 63.1 |
| Compacted | 60 | 52.3 | 2.8 | 2.9 | 12.1 | 9.6 | 64.2 | 55.7 |
| S+C | 50 | 50.5 | 2.4 | 2.5 | 14.3 | 9.4 | 53 | 77.8 |
| 4 | | | | | | | | |
| Control | | 11.3 | 3.6 | 2.3 | 4.0 | 2.2 | 35.3 | 39.3 |
| compacted | 50 | 12.0 | 2.7 | 2.2 | 3.9 | 2.0 | 44.6 | 38.3 |
| Compacted | 60 | 12.2 | 2.6 | 2.2 | 4.5 | 2.7 | 40.8 | 41.8 |
| S+C | 50 | 12.8 | 2.1 | 1.2 | 4.7 | 1.9 | 42.7 | 47.4 |

Note:
S+C = "stretched then compacted".
Compacted 50 = "50 Shore A Durometer blanket".
Compacted 60 = "60 Shore A Durometer blanket".

STRETCHING

Sufficient draw was applied to the web to cause it to undergo a 12–15% reduction in width prior to entering the compactor. Speed differential necessary to accomplish this was approximately 20–25%.

COMPACTION

Compaction conditions, whether or not web stretching preceded compaction, were as follows:

| | |
|---|---|
| Nip | 15% |
| Cylinder Temperature* | 140° F |
| Cylinder Surface | "Teflon" |
| Blanket Tension | 60 pli |
| Sheet Moisture | Air Dry |

*Higher temperatures were found to have a negative effect on softness.

It can be seen that in all cases significant reductions in stiffness resulted from stretching and compacting as compared to simple compaction. This is true not only of MD stiffness but is particularly true also of CD stiffness. Also, the table shows that the tensile strength of the web, in at least the machine direction (MD) was significantly increased.

In addition to the above, other types of nonwoven fabrics were treated, as follows:

EXAMPLE II

A wet formed fabric composed of a combination of 1 ½ inch long nylon and ½ inch rayon fibers bonded with a thermoplastic binder.

| | Control (Uncompacted) | Compacted Only | Stretched 10% + Compacted | Stretched 16% + Compacted |
|---|---|---|---|---|
| Tensile (lbs/inch) | | | | |
| MD | 5.7 | 5.0 | 5.1 | 5.1 |
| CD | 4.1 | 4.2 | 4.0 | 3.7 |
| Elongation (%) | | | | |
| MD | 9.3 | 20.1 | 12.6 | 11.2 |
| CD | 10.2 | 10.0 | 14.3 | 17.8 |
| Stiffness (Inches) | | | | |
| MD | 6.0 | 2.7 | 3.0 | 3.2 |
| CD | 5.2 | 4.8 | 3.5 | 2.6 |
| Basis Wt. (oz/yd$^2$) | 1.35 | | 1.47 | 1.44 |

Note:
In order to stretch this fabric by the amounts shown above, it was necessary to first increase the moisture in the material to 18%. This allowed the material to be stretched without rupture. Moisture was applied with a steam shower and material ws partially dried to approximately 10% moisture prior to compaction.

EXAMPLE III

A dry formed fabric of 1 to ½ inch long rayon fibers bonded with a thermoplastic binder.

| | Control (Uncompacted) | Compacted Only | Stretched 14% & Compacted |
|---|---|---|---|
| Tensile (lb/in) | | | |
| MD | 2.9 | 3.0 | 3.3 |
| CD | 1.8 | 2.1 | 1.7 |
| Elongation (%) | | | |
| MD | 14.3 | 23.7 | 17.0 |
| CD | 13.8 | 14.2 | 20.2 |
| Stiffness (inches) | | | |
| MD | 4.9 | 2.2 | 2.3 |
| CD | 4.2 | 3.6 | 2.3 |
| Basis Weight (oz/yd$^2$) | 2.0 | 2.2 | 2.2 |

Note: Material was heated to 180° F in order to facilitate the stretching. Compaction was also accomplished at 180° F.

While the foregoing description refers to only a blanket type compactor, it is to be understood that other forms of compacting means may be used, such as two-roll devices capable of simultaneous compaction in both machine and cross directions.

I claim:

1. The method of treating nonwoven fabrics to increase the softness and flexibility thereof in transverse directions, comprising the steps of:

feeding a web of said fabric through a stretching zone and applying longitudinal tension to said web, in the feed direction, sufficient to elongate the generally longitudinally extending filaments thereof and thereby reduce the transverse dimensions of said web and buckle the generally transversely extending filaments thereof; and thereafter compacting a substantial proportion of said longitudinally elongated filaments of said web in the longitudinal direction by shortening them in their longitudinal direction while maintaining said web against increase in thickness or creping.

2. The method defined in claim 1 wherein said longitudinal compacting step is initiated while said web is under tension.

3. The method defined in claim 1 including the step of relieving the tension in said web prior to initiating said longitudinal compacting step.

4. The method claimed in claim 1 wherein said tension is sufficient to elongate said web an amount of the order of 15% to 25%.

5. The method defined in claim 1 including the further step of holding said web of reduced transverse dimension against lateral expansion while longitudinally compacting the same.

* * * * *